United States Patent [19]

Wood

[11] Patent Number: 4,493,415

[45] Date of Patent: Jan. 15, 1985

[54] BASKET-STYLE ARTICLE CARRIER WITH MEDIAL SEPARATOR

[75] Inventor: Prentice J. Wood, Hapeville, Ga.

[73] Assignee: The Mead Corporation, Dayton, Ohio

[21] Appl. No.: 461,808

[22] Filed: Jan. 28, 1983

[51] Int. Cl.[3] ..... B65D 75/00

[52] U.S. Cl. ..... 206/175; 206/143; 206/181; 206/188; 206/198; 206/141; 206/187; 229/28 BC; 229/52 BC

[58] Field of Search ..... 206/140, 141, 142, 143, 206/172, 175, 180, 181, 188, 187, 198, 427, 430, 434; 229/28 BC, 52 BC

[56] References Cited

U.S. PATENT DOCUMENTS

| | | | |
|---|---|---|---|
| 3,456,841 | 7/1969 | Mahon et al. | 206/172 |
| 3,567,069 | 3/1971 | Harrelson | 206/187 |
| 3,724,714 | 4/1973 | Wright | 206/187 |
| 3,827,550 | 8/1974 | Arneson | 229/52 BC |
| 3,857,483 | 12/1974 | Wood | 206/187 |
| 4,406,365 | 9/1983 | Kulig | 206/175 |
| 4,413,728 | 11/1983 | Wood | 206/187 |
| 4,413,729 | 11/1983 | Wood | 206/188 |

*Primary Examiner*—Joseph Man-Fu Moy
*Assistant Examiner*—David Fidei
*Attorney, Agent, or Firm*—Erwin Doerr

[57] ABSTRACT

A cellular basket-style carrier has a pair of side walls (2, 3) one of the side walls (2) having a base panel (5) hinged thereto and the other of the side walls (3) having a connecting flap (10) hinged thereto and joining the base panel to the other side wall (3). Medial panels (14, 14*a;* 18, 18*a*) together provide both a central longitudinal partition structure (5) of the carrier and transverse partition structures on either side of said longitudinal partition structure. Each of the medial panels (18, 18*a*) associated with the other of the side walls (3) has a separator panel (46, 46*a*) hinged thereto which together provide a multiply separator (M) centrally of the carrier in the plane of said longitudinal partition structure.

4 Claims, 6 Drawing Figures

BASKET-STYLE ARTICLE CARRIER WITH MEDIAL SEPARATOR

This invention relates to a basket-style cellular article carrier of the type which is fabricated from a single blank of flexible sheet material, the blank being cut and creased so that it is divided into a number of panels which thereafter are folded and secured in a predetermined relationship with respect to one another so as to provide an article carrier having a multiplicity of article accommodating cells. The carrier is particularly suitable for accommodating bottles.

Cellular bottle carriers have been designed for use in connection with the marketing of bottled beverages and have been fabricated from relatively lightweight stock such that the individual cells are separated by the thickness of material required in order to meet railroad shipping regulations. In order to achieve this, most such carriers include the provision of a two-ply thickness of material between individual cells. However, in some constructions in order to meet this provision a wasteful amount of material is lost during the fabrication of the carrier from the stock. The present invention achieves the required result with reduced material wasteage thus achieving an economical conversion of material.

The invention is particularly concerned with the formation of a medial separator between the central cells of a basket-type carrier. That is to say, a separator which lies in the plane of the central longitudinal partition structure of the carton.

In a typical construction of a carton of this type a medial or longitudinal partition structure extends inwardly from respective end walls of the carton. Each such longitudinal partition structure carries a transverse partition structure which is hingedly connected to an adjacent side wall of the carton to provide, and give adequate separation between, the individual article cells. A base wall normally is integrally hinged to one carton side wall and is connected to the opposite side wall by means of a glue flap.

In a known construction a medial separator is formed from a pair of overlapping separator panels which are hinged to those medial panels associated with the side wall of the carton to which the base panel is hinged. These known separator panels whilst achieving the desired separation thickness are relatively large and are positioned on the carrier blank in a manner which does not facilitate the most economical method of stamping the blanks from the web stock.

The present invention gives an improved blank layout and also a reduction in size of such separator panels leading to economical savings in material.

To this end one aspect of the invention provides a blank for forming a cellular basket-style carrier which blank comprises a pair of central panels respectively providing side walls of the carrier, one of said central panels having a base panel hinged thereto for forming the base of the carrier and the other of said central panels having a connecting flap hinged thereto for joining the base panel to said other central panel, each of said central panels having a pair of end wall panels hinged thereto and each of said end wall panels having a medial panel hinged thereto, said medial panels together providing both a central longitudinal partition structure of the carrier and transverse partition structures on either side of said longitudinal partition structure, characterized in that each of the medial panels associated with said other of the central panels has a separator panel hinged thereto for providing together a multiply separator centrally of the carrier in the plane of said longitudinal partition structure.

According to a feature of this aspect of the invention the extreme edges of said separator panels, remote from their hinged connections to respective ones of the medial panels, may lie along a notional line which itself lies no farther beyond a notional line containing that extreme edge of said connecting flap which is remote from its hinged connection to said other central panel.

Another aspect of the invention provides a cellular basket-style carrier which comprises a pair of side walls one of said side walls having a base panel integrally hinged thereto for forming the base of the carrier and the other of said side walls having a connecting flap integrally hinged thereto and joining the base panel to said other side wall, each of said side walls having a pair of end wall panels hinged thereto and each of said end wall panels having a medial panel hinged thereto, said medial panels together providing both a central longitudinal partition structure of the carrier and transverse partition structures on either side of said longitudinal partition structure, characterized in that each of the medial panels associated with said other of the side walls has a separator panel hinged thereto which together provide a multiply separator centrally of the carrier in the plane of said longitudinal partition structure.

Another aspect of the invention provides a cellular basket-style carrier fabricated from a unitary blank of foldable sheet material and comprising a base wall, spaced side walls hinged to opposite edges of the base wall, end wall panels hinged to the end edges of said side walls and extending inwardly therefrom, a medial partition structure formed from medial panels at each end of the carrier, a transverse partition structure hinging together each medial panel to an adjacent one of said side walls by means of an anchor tab, one pair of said medial panels each having a separator panel hinged thereto, said separator panels being secured to one another in overlapping relationship so as to form a multiply separator which interconnects, adjacent the base wall of the carrier, each of said medial partition structures, characterized in that the maximum height of said multiply separator where said separator panels are overlapped as measured from said base wall is below the lowermost edge of each of said anchoring tabs as measured from said base wall.

An embodiment of the invention is now described below, by way of example only, reference being made to the accompanying drawings, in which.

Figure 1:
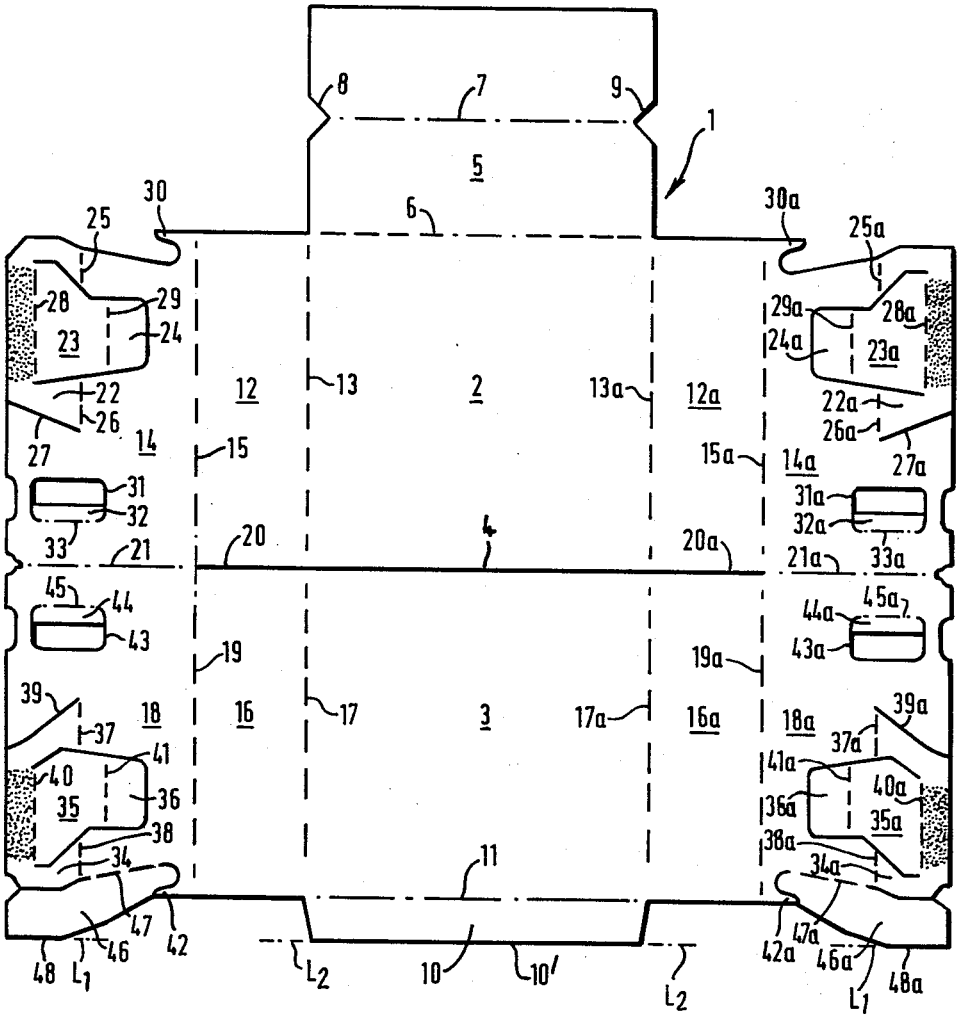
FIG. 1 is a plan view of a blank from which the article carrier shown in FIG. 6 is formed.
Figure 6:
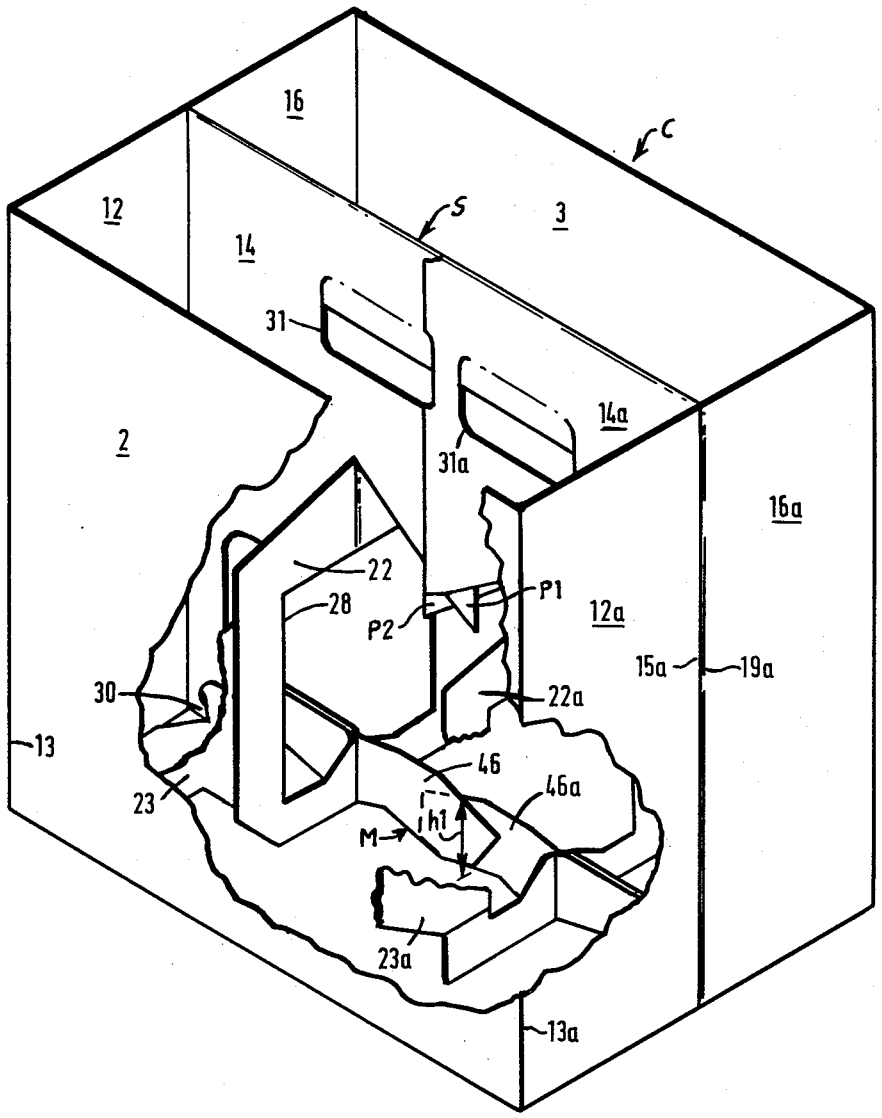

Referring to the drawings, there is shown a cellular carton 'c' of the basket-type as illustrated in FIG. 6 which is formed from a blank 1 of paperboard or similar foldable sheet material (FIG. 1).

The carton comprises side walls 2 and 3 separated from one another along a central line of cut 4. A base panel 5 is hinged to the side wall 2 along fold line 6 and includes a central fold line 7 extending between a pair of 'V'-notches 8 and 9, parallel to the fold line 6. The free end edge of the base panel 5 is arranged to be secured to a glue flap 10 hinged to the other side wall 3 along fold line 11.

At one end of the carton, end wall panel 12 has one of its edges hinged to an end edge of side wall 2 along fold line 13 and a medial panel 14 is hinged to the opposite edge of end wall panel 12 along a fold line 15. Similarly, end wall panel 16 has one of its edges hinged to an end edge of side wall 3 along fold line 17 and a medial panel 18 is hinged to the opposite edge of end wall panel 16 along a fold line 19. The end wall panels 12 and 16 are separated from one another by a line of cut 20 whereas the medial panels are hinged to one another along fold line 21. Both the line of cut 20 and fold line 21 are coextensive with the central cut line 4.

To provide the cellular construction, the medial panel 14 carries a transverse partition structure comprising a main transverse partition panel 22, a supplementary transverse partition structure 23 and an anchor tab 24. The main transverse partition structure 22 is hinged to medial panel 14 along fold lines 25 and 26 and is separated from medial panel 14, in order to allow folding thereof, along an oblique line of cut 27. Supplementary transverse partition panel 23 is struck partially from the medial panel 14 and partially from the main transverse partition panel 22 and is hinged to the latter along fold line 28. Anchor tab 24 is struck from medial panel 14 and is hinged to supplementary transverse partition panel 23, remote from fold line 28, along a fold line 29. The medial panel 14 further includes locking projection 30 and a finger aperture 31 to facilitate portage of the carton. The finger aperture carries a cushioning flap 32 hinged at one peripheral edge of the aperture along fold line 33.

Medial panel 18 carries a transcerse partition structure of similar arrangement to that of medial panel 14, and which comprises main transverse partition panel 34, a supplementary transverse partition structure 35 and an anchor tab 36. The main transverse partition structure 34 is hinged to medial panel 18 along fold lines 37 and 38 and is separated from medial panel 18, in order to allow folding thereof, along an oblique line of cut 39. Supplementary transverse partition panel 35 is struck partially from the medial panel 18 and partially from the main transverse partition panel 34 and is hinged to the latter along fold line 40. Anchor tab 36 is struck from medial panel 18 and is hinged to supplementary transverse partition panel 35, remote from fold line 40, along a fold line 41. The medial panel 18 further includes locking projection 42 and finger aperture 43. The finger aperture carries a cushioning flap 44 hinged at one peripheral edge of the aperture along fold line 45.

The medial panel 18 also carries a bottle heel separator panel 46 which is hinged thereto along fold line 47. The separator panel 46 is sized such that when the carton blank is in flat unfolded condition, the lowermost extreme edge 48 of the separator panel is approximately aligned with the lowermost extreme edge 10' of glue flap 10. This feature permits an improved blank layout since material wastage is reduced.

The opposite end of the carton is of similar construction to that above described and like reference numerals designate like parts with the addition of suffix 'a'. It also will be appreciated from FIG. 1 that the carton blank is symmetrical about line bisecting the base panel 5, the side walls 2, 3 and the glue flap 10.

As shown in FIG. 1, the extreme edges of the separator panels 48, 48*a*, respectively remote from their hinged connections at 47 and 47*a* to respective ones of medial panels 18 and 18*a* lie along a notional line '$L_1$'. Notional line $L_1$ preferably lies within, or at most no farther beyond, a notional line '$L_2$' which contains the extreme edge 10' of the connecting flap 10. Hence, a blank nesting arrangement may be achieved in which the base panels of adjacent blanks in one row can be placed in alternate arrangement with the base panels of adjacent blanks in a first neighboring row. A second neighboring row of blanks may then be placed back to back with respect to the blanks in the said one row, and so on. This arrangement makes for a substantial saving in material since the adjacent base panels of neighboring rows can be closely positioned one next to the other.

In order to form the completed carton in flat collapsed condition, first an application of glue is made to those areas of the carton blank shown in stippling in FIG. 1. Thereafter, the supplementary transverse partition panels 23 and 35 together with their associated anchor tabs 24 and 36 are rotated toward the left 180° out of the plane of the blank about fold lines 28 and 40, respectively, so that portions of each of those main and supplementary transverse partition panels adjacent the respective fold lines 28, 40 are brought into face to face relationship.

Similarly, the supplementary transverse partition panels 23*a* and 35*a* together with their associated anchor tabs 24*a* and 36*a* are rotated toward the right 180° out of the plane of the blank about fold lines 28*a* and 40*a*, respectively, so that portions of each of those main and supplementary transverse partition panels adjacent the respective fold lines 28*a*, 40*a* are brought into face to face relationship.

Figure 2:
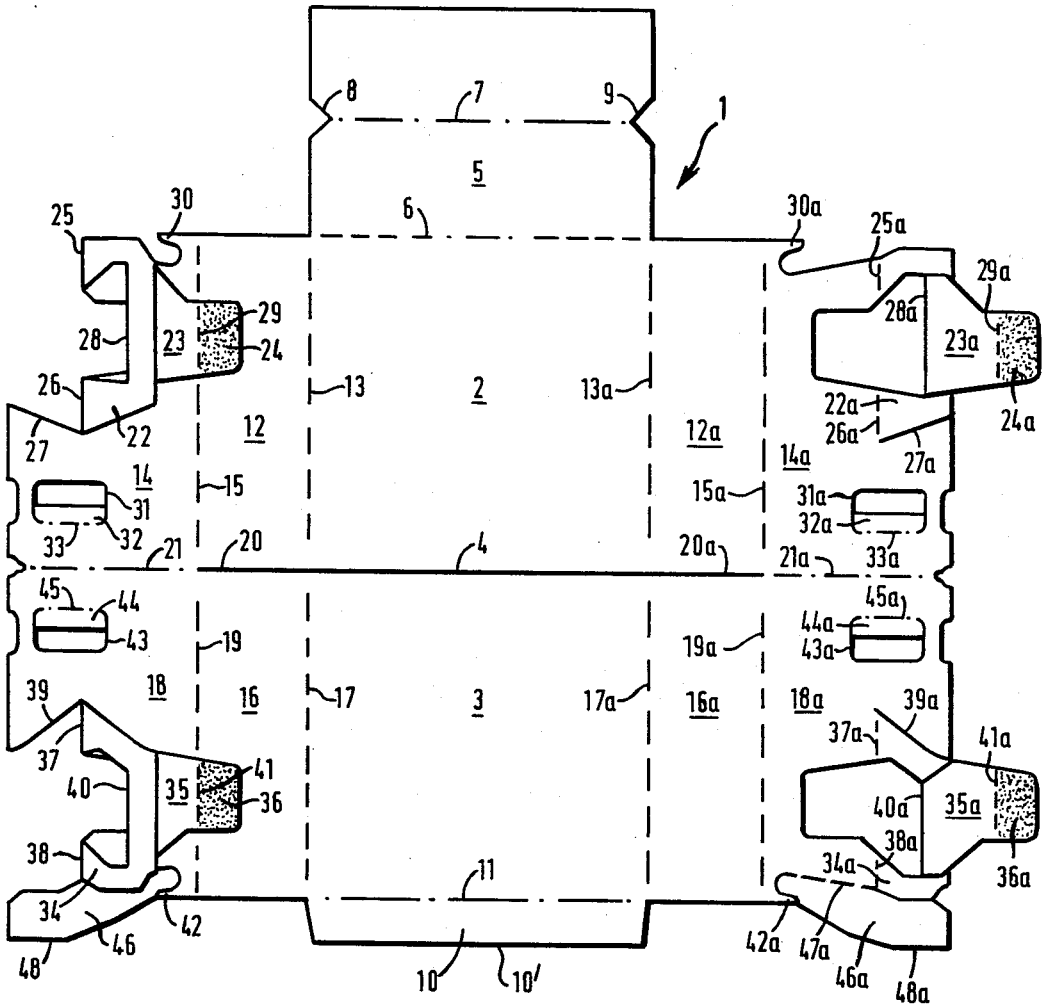
FIG. 2 to 4 depict intermediate stages through which the blank of FIG. 2 is manipulated in order to form a complete and collapsed article carrier as shown in FIG. 5; and, FIG. 6 is a perspective view of an article carrier shown in set-up empty condition with a portion thereof broken away.
Figure 3:
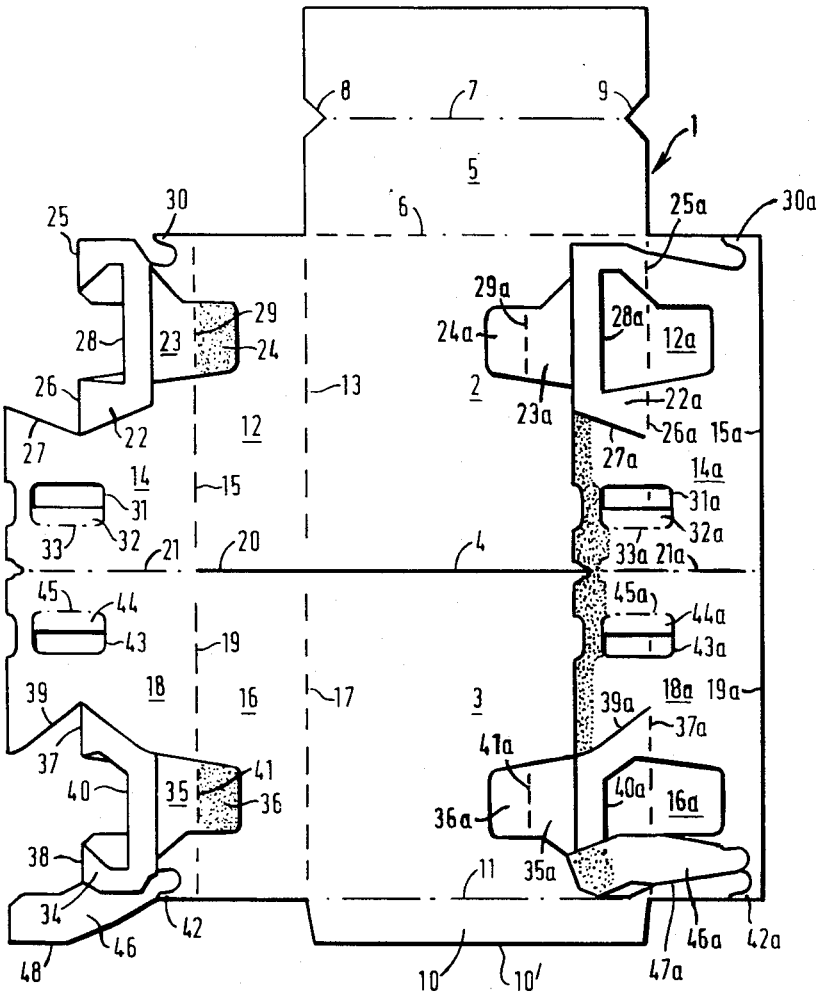

Subsequently, each of the main transverse partition panels 22 and 34 are folded toward the right 180° out of the plane of the blank about fold lines 25, 26 and 37, 38 respectively. Glue is then applied to the upward facing surfaces of each of the anchor tabs 24, 36, 24*a* and 36*a*. The blank is then in the configuration illustrated in FIG. 2, in which the glued areas are shown in stippling. Alternatively glue may be applied to appropriate areas of the side wall panels on which the anchor tabs are to register. Following this folding operation, medial panels 14*a* and 18*a* are rotated together toward the left 180° out of the plane of the blank about fold lines 15*a* and 19*a* so that anchor tabs 24*a* and 36*a* are secured to side walls 2 and 3, respectively. Generally simultaneously with the medial panel folding, the separator panel 46*a* is folded upwardly out of the plane of the blank so that it is disposed in face contacting relationship with the upward facing surface of medial panel 18*a*. The blank is then in the configuration shown in FIG. 3 during which time glue is applied to those areas shown in stippling.

Immediately afterwards, end wall panels 12 and 16 together with medial panels 14 and 18 are rotated toward the right 180° out of the plane of the blank about fold lines 13 and 17. This folding operation secures the anchor tabs 24 and 36 to side walls 2 and 3, respectively, and secures the free edges of medial panels 14 and 18 intermediate the transverse partition structures in overlapping relationship with the corresponding areas of medial panels 14*a* and 18*a*. Generally simultaneously with this folding operation, the separator panel 46 is folded upwardly out of the plane of the blank so that it is disposed in face contacting relationship with the upward facing surface of medial panel 18. Also the base panel 5 is folded in two about its central fold line 7. The blank is then in the configuration shown in FIG. 4 and a final application of glue is made to those areas of the blank shown in stippling.

Figure 4:
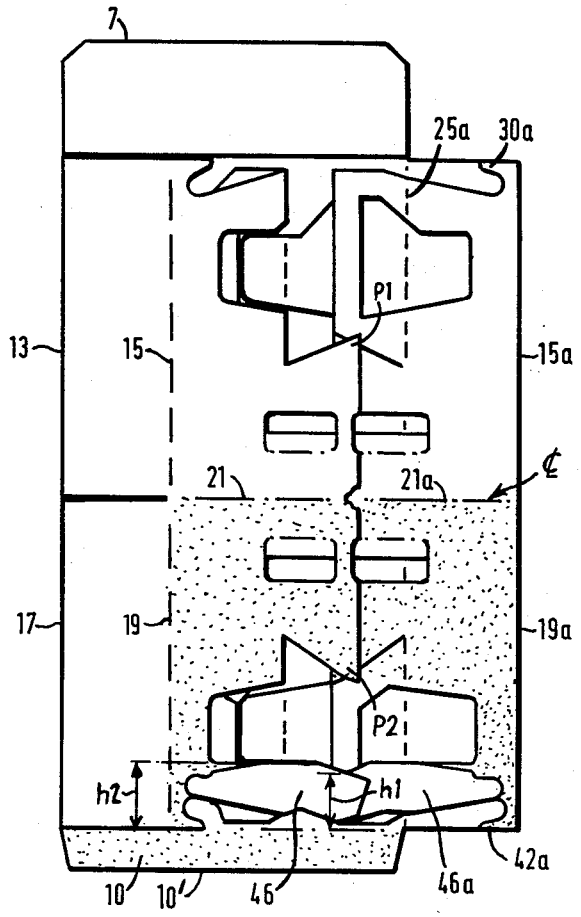

It will be appreciated from FIG. 4 that those overlapped areas of the medial panels designated $P_1$ and $P_2$ formed by virtue of the positioning and angle of the oblique lines of cut 27, 27*a* and 39, 39*a* will form further multi-ply separators as will be apparent with reference to FIG. 6.

Figure 5:
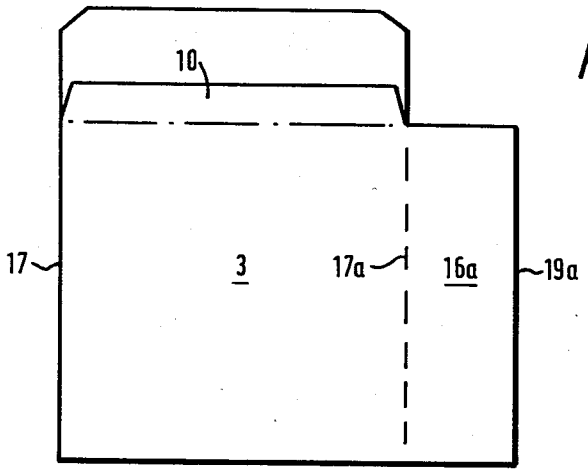

In order to complete the carton in collapsed form, the blank is folded about the symmetrical centreline 'CL' to that the glue flap 10 is secured to the free edge of base panel 5. The carton is then in the form illustrated in FIG. 5 which represents the completed carton in flat collapsed condition.

The carton may be erected into set-up condition in a manner which is well known to the art. A cut-away view of the set-up carton is shown in FIG. 6. In order to maintain the carton in set-up condition one or other of the locking projections 42, 42*a* formed in medial panels 18, 18*a* engage in the adjacent 'V'-notch 8 or 9. In order to form the locking projections 42, 42*a*, each of the separator panels 46, 46*a* has an end part remote from its free side edge which is shaped so as to form a 'nose' which produces the recessed throat of the locking projection when that separator panel is folded about its hinged connection out of the plane of the blank. When the blank is unfolded, the free end edge of each separator panel is substantially in alignment with that free edge of the adjacent main transverse partition panel which is remote from its hinged connection to the associated medial panel.

Referring to FIG. 6, it will be seen that the overlapped separator panels 46, 46*a* form a multiply separator 'M' centrally of the carrier in the plane of the longitudinal partition structure 'S'. Separator 'M' thus formed give protection to the heel parts of a pair of adjacent bottles disposed one on either side of partition structure 'S'. The size of the separator 'M', although greatly reduced in comparison to prior art constructions, is nevertheless quite sufficient to give the required degree of protection. In fact it will be seen that the maximum height '$h_1$' of the separator 'M' at the position where the separator panels 46, 46*a* are overlapped (as measured from the carton base panel) is less than (or below) that of the lowermost edge '$h_2$' of the anchoring tabs (as measured from the carton base panel).

The further separator produced by the overlapped panel parts $P_1$, $P_2$ serve to give protection to the shoulder parts of the same centrally disposed bottles.

I claim:

1. A blank (1) for forming a cellular basket-style carrier (c) which blank comprises a pair of central panels (2, 3) respectively providing side walls of the carrier, one of said central panels (2) having a base panel (5) hinged thereto for forming the base of the carrier and the other of said central panels (3) having a connecting flap (10) hinged thereto for joining the base panel to said other central panel, each of said central panels having a pair of end wall panels (12, 12*a*: 16, 16*a*) hinged thereto and each of said end wall panels having a medial panel (14, 14*a*: 18, 18*a*) hinged thereto, said medial panels together providing both a central longitudinal partition structure (S) of the carrier and transverse partition structures on either side of said longitudinal partition structure when the carrier is erected, the medial panels (18, 18*a*) associated with one of said central panels (2, 3) having a separator panel (46, 46*a*) hinged thereto for providing together a multi-ply separator (M) centrally of the carrier in the plane of said longitudinal partition structure, each of said transverse partition structures comprising a main transverse partition panel (22, 22*a*: 34, 34*a*) hinged to the medial panel, a supplementary transverse partition panel (23, 23*a*: 35, 35*a*) hinged to the main transverse partition panel, and an anchoring tab (24, 24*a*: 36, 36*a*) hinged to the supplementary transverse partition panel, characterized in that each of said separator panels is struck partially from the medial panel to which it is hinged and partially from the main transverse partition panel associated with that medial panel.

2. A blank according to claim 1, further characterized in that the extreme edges of said separator panels remote from their hinged connections to respective ones of the medial panels lie along a notional line which itself lies no farther beyond a notional line containing that extreme edge of said connecting flap which is remote from its hinged connection to said one of said central panels.

3. A blank according to claim 1, further characterized in that each of said main transverse partition panels is separated from its associated medial panel by an oblique line of cut (27, 27*a*: 39, 39*a*) and in that areas of the medial panels immediately adjacent said lines of cut together provide a multiply separator ($P_1$, $P_2$) centrally of the carrier in the plane of said longitudinal partition structure and above the separator formed by said separator panels with respect to said carrier base.

4. A cellular basket-style carrier fabricated from a unitary blank of foldable sheet material and comprising a base wall (5), spaced side walls (2, 3) hinged to opposite edges of the base wall, end wall panels (12, 12*a*: 16, 16*a*) hinged to the end edges of said side walls and extending inwardly therefrom, a medial partition structure formed from medial panels (14, 4*a*: 18, 18*a*) at each end of the carrier, a transverse partition structure hinging together each medial panel to an adjacent one of said side walls by means of an anchor tab (24, 24*a*: 36, 36*a*), one pair (18, 18*a*) of said medial panels each having a separator panel (46, 46*a*) hinged thereto, said separator panels being disposed in overlapping relationship with respect to each other so as to form a multiply separator which interconnects, adjacent the base wall of the carrier, each of said medial partition structures, characterized in that each of said separator panels is struck at least partially from said medial panel to which it is hinged.

* * * * *